US008992259B2

(12) United States Patent
Miwa et al.

(10) Patent No.: US 8,992,259 B2
(45) Date of Patent: Mar. 31, 2015

(54) CONNECTOR HAVING NOISE REMOVAL CAPABILITY

(75) Inventors: Takeya Miwa, Makinohara (JP); Tadashi Hasegawa, Kikugawa (JP); Takahito Nakashima, Toyota (JP); Hiroshi Kobayashi, Toyota (JP); Saori Muramatsu, Toyota (JP)

(73) Assignees: Yazaki Corporation, Tokyo (JP); Toyota Jidosha Kabushiki Kaisha, Aichi-ken (JP)

( * ) Notice: Subject to any disclaimer, the term of this patent is extended or adjusted under 35 U.S.C. 154(b) by 60 days.

(21) Appl. No.: 13/825,201

(22) PCT Filed: Sep. 21, 2011

(86) PCT No.: PCT/JP2011/072303

§ 371 (c)(1), (2), (4) Date: Mar. 20, 2013

(87) PCT Pub. No.: WO2012/039510

PCT Pub. Date: Mar. 29, 2012

(65) Prior Publication Data

US 2013/0303023 A1 Nov. 14, 2013

(30) Foreign Application Priority Data

Sep. 21, 2010 (JP) ..... 2010-210775

(51) Int. Cl.
*H01R 13/66* (2006.01)
*H01R 13/7193* (2011.01)
(Continued)

(52) U.S. Cl.
CPC ..... *H01R 13/7193* (2013.01); *H01R 13/7195* (2013.01); *H01R 13/506* (2013.01); *H01R 13/7197* (2013.01)
USPC ..... 439/620.05

(58) Field of Classification Search
CPC ..... H01R 13/506; H01R 13/7193; H01R 13/7197; H01R 13/7195
USPC ..... 439/620.05
See application file for complete search history.

(56) References Cited

U.S. PATENT DOCUMENTS 5,018,990 A 5/1991 Sakamoto et al.
5,213,522 A * 5/1993 Kojima ..... 439/620.07
(Continued)

FOREIGN PATENT DOCUMENTS

EP 0 682 386 A2 11/1995
JP 2002-33153 A 1/2002
(Continued)

OTHER PUBLICATIONS

Office Action dated Mar. 17, 2014 issued by the Korean Intellectual Property Office in counterpart Korean Patent Application No. 10-2013-7007225.
(Continued)

*Primary Examiner* — Javaid Nasri
(74) *Attorney, Agent, or Firm* — Sughrue Mion, PLLC

(57) ABSTRACT

There is provided a connector capable of reducing deterioration of the noise removal capability by suppressing deformation of a ferrite. The connector includes: a housing which is provided with a plurality of connector fitting portions to be fitted in a plurality of mating connectors, respectively; a plurality of terminals which are attached to the housing to project within the plurality of connector fitting portions, respectively; a plurality of ferrites which remove noise generated from the plurality of terminals, each ferrite being provided for the respective one of the connector fitting portions and having a through hole through which each of the plurality of terminals passes; and a plurality of pressing arms which are provided in the housing, each pressing arm holding the respective one of the plurality of ferrites.

6 Claims, 15 Drawing Sheets

(51) Int. Cl.

| | |
|---|---|
| ***H01R 13/7195*** | (2011.01) |
| ***H01R 13/506*** | (2006.01) |
| ***H01R 13/7197*** | (2011.01) |

(56) References Cited

U.S. PATENT DOCUMENTS

| | | | |
|---|---|---|---|
| 5,286,221 | A | 2/1994 | Fencl et al. |
| 5,415,569 | A | 5/1995 | Colleran et al. |
| 5,551,893 | A | 9/1996 | Johnson |
| 5,823,826 | A | 10/1998 | Ward et al. |
| 6,059,608 | A | 5/2000 | Benes |
| 6,086,422 | A | 7/2000 | Glynn |
| 6,435,894 | B2 | 8/2002 | Little et al. |
| 6,467,165 | B1 | 10/2002 | Glynn |
| 6,663,411 | B2 | 12/2003 | Little |
| 2002/0009924 | A1 | 1/2002 | Little et al. |
| 2002/0137397 | A1 | 9/2002 | Little |

FOREIGN PATENT DOCUMENTS

| | | | |
|---|---|---|---|
| JP | 2008-159311 | A | 7/2008 |
| JP | 2010-61901 | A | 3/2010 |
| WO | 97/16872 | A1 | 5/1997 |

OTHER PUBLICATIONS

Office Action, dated Oct. 22, 2010, issued by the Japanese Patent Office in counterpart Japanese Application No. 2010-210775.

International Search Report (PCT/ISA/210), dated Nov. 18, 2011, issued by the International Searching Authority in counterpart International Patent Application No. PCT/JP2011/072303.

Written Opinion (PCT/ISA/237), dated Nov. 18, 2011, issued by the International Searching Authority in counterpart International Patent Application No. PCT/JP2011/072303.

Office Action dated Oct. 30, 2014 issued by the State Intellectual Property Office of the People's Republic of China in counterpart Chinese Application No. 201180045531.7.

* cited by examiner

RELATED ART

RELATED ART

CONNECTOR HAVING NOISE REMOVAL CAPABILITY

TECHNICAL FIELD

The present invention relates to a connector having a noise removal cap ability.

BACKGROUND ART

A connector having a noise removal capability is known. As an example of the connector, Patent Literature 1 discloses a connector in which a ferrite plate is insert-molded within a housing. Hereinafter, the configuration of the connector disclosed in Patent Literature 1 will be explained with reference to FIG. 17 and FIG. 18.

As shown in FIG. 17, a connector 201 includes a housing 202 made of a synthetic resin, a conductor 5 and a ferrite plate 208. The housing 202 includes a plurality of connector fitting portions 230 for fitting to a plurality of mating connectors, respectively. The conductor 5 includes a plurality of terminals 6 which project within the connector fitting portions 230, respectively, and a linking part 7 which links the plurality of terminals 6 to one another. The ferrite plate 208 removes noise from the plurality of terminals 6.

As shown in FIG. 18, the ferrite plate 208 is formed in an elongated plate shape. A plurality of through holes 280 through which the terminals 6 of two conductors 5 pass, respectively.

Both the conductor 5 and the ferrite plate 208 are insert-molded into the housing 202 in a state where the plurality of terminals 6 pass through the though holes 280, respectively.

CITATION LIST

Patent Literature

Patent Literature 1; JP-A-2010-61901

SUMMARY OF INVENTION

Technical Problem

The connector 201 has a problem that the noise removal capability of the ferrite plate 208 is deteriorated due to the distortion of the ferrite plate 208 which occurs by a contraction stress of the housing 202 when the ferrite plate 208 is insert-molded into the housing 202.

An object of the present invention is to provide a connector capable of reducing deterioration of the noise removal capability by suppressing deformation of a ferrite.

Solution to Problem

According to a first aspect of the invention, there is provided a connector including: a housing which is provided with a plurality of connector fitting portions to be fitted in a plurality of mating connectors, respectively; a plurality of terminals which are attached to the housing to project within the plurality of connector fitting portions, respectively; a plurality of ferrites which remove noise generated from the plurality of terminals, each ferrite being provided for the respective one of the connector fitting portions and having a through hole through which each of the plurality of terminals passes; and a plurality of pressing arms which are provided in the housing, each pressing arm holding the respective one of the plurality of ferrites.

The connector may be configured, as a second aspect, so that each of the ferrites are formed in a rectangular plate shape, and the through hole is formed through a center of the rectangular plate shape, the plurality of pressing arms are provided in pair for each of the plurality of ferrites, and each pair of pressing arms are arranged to sandwich the respective one of the ferrites between the pair of pressing arms.

The connector may be configured, as a third aspect, so that an eliminated part is formed on a center of each of the pressing arms so that each pair of pressing arms presses four corners of the respective one of the ferrites and is prevented from contact with centers of side surfaces of the respective one of the ferrites.

The connector may be configured, as a fourth aspect, so that the housing includes a first housing and a second housing, the first housing being provided with the plurality of connector fitting portions, and the second housing being provided with the plurality of pressing arms and assembled to the first housing, each of the ferrites has a first surface on which the through hole is open and a second surface opposite to the first surface on which the through hole is open, the second housing is provided with a contact surface which contacts the first surface of each of the ferrites, and the first housing is provided with a plurality of anti-drop portions which come close to or contact with the second surface of each of the ferrites to prevent each of the ferrites from being dropped from the second housing.

Advantageous Effects of Invention

According to the first aspect of the invention, the plurality of ferrites which remove noise generated from the plurality of terminals are provided, and each ferrite is provided for the respective one of the connector fitting portions and having the through hole through which each of the plurality of terminals passes. Further, the plurality of pressing arms are provided in the housing, and each pressing arm holds the respective one of the plurality of ferrites. Accordingly, the pressure to be applied to the ferrite can be lowered in comparison with a case where a ferrite is t-molded into the housing. Thus, it is possible to suppress the deformation of the ferrite. Further, the pressure to be applied to the ferrite can be lowered in comparison with a case where a plurality of ferrites are integrally molded. Thus, it is possible to suppress the deformation of the ferrite. Thus, it is possible to provide a connector capable of suppressing the deterioration of the noise removal capability of each ferrite.

According to the second aspect of the invention, each of the ferrites are formed in a rectangular plate shape, and the through hole is fanned through the center of the rectangular plate shape, the plurality of pressing arms are provided in pair for each of the plurality of ferrites, and each pair of pressing arms are arranged to sandwich the respective one of the ferrites between the pair of pressing arms and press four corners of the respective one of the ferrites. Accordingly, the pressure to be applied to the ferrite can be minimized by the pair of pressing arms. Thus, it is possible to suppress the deformation of the ferrite. Thus, it is possible to provide a connector capable of suppressing the deterioration of the noise removal capability of each ferrite.

According to the third aspect of the invention, the eliminated part is formed on the center of each of the pressing arms so that each pair of pressing arms presses the four corners of the respective one of the ferrites and is prevented from contact with centers of side surfaces of the respective one of the ferrites. Accordingly, the pressure to be applied to the ferrite can be minimized by the pair of pressing arms. Thus, it is possible to suppress the deformation of the ferrite. Thus, it is possible to provide a connector capable of suppressing the deterioration of the noise removal capability of each ferrite.

According to the fourth aspect of the invention, the housing includes the first housing and the second housing, the first housing being provided with the plurality of connector fitting portions, and the second housing being provided with the plurality of pressing arms and assembled to the first housing. Each of the ferrites has a first surface on which the through hole is open and a second surface opposite to the first surface on which the through hole is open. The second housing is provided with a contact surface which contacts the first surface of each of the ferrites, and the first housing is provided with a plurality of anti-drop portions which come close to or contact with the second surface of each of the ferrites to prevent each of the ferrites from being dropped from the second housing. Thus, the ferrite is prevented from being dropped from the second housing.

DESCRIPTION OF EMBODIMENTS

A connector according an embodiment of the invention will he explained with reference to FIG. 1 through FIG. 11. A connector 1 according to the embodiment is typically used as a joint connector for multiplex communication.

Figure 1:
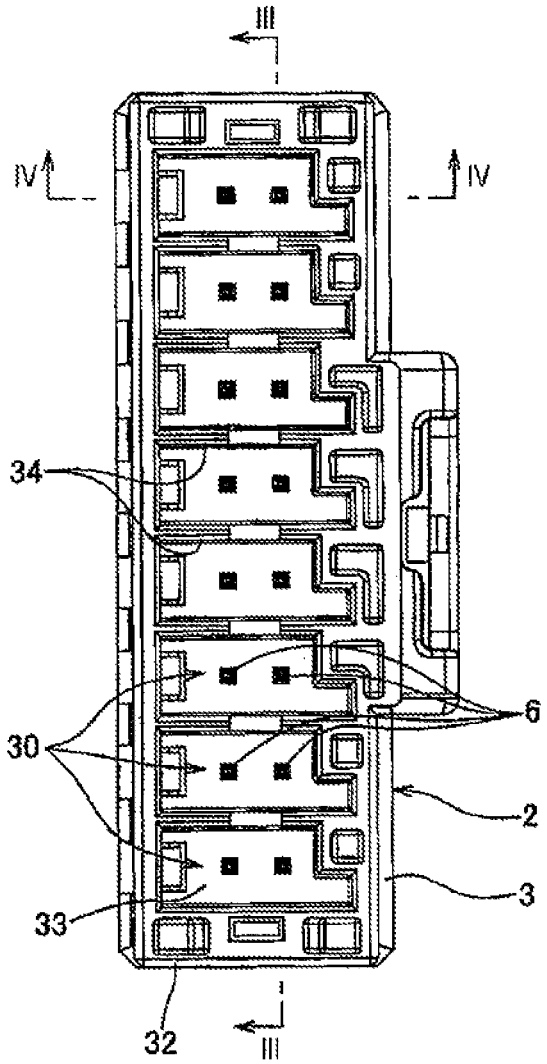
FIG. 1 is a plan view showing a connector according to an embodiment of the invention.
Figure 2:
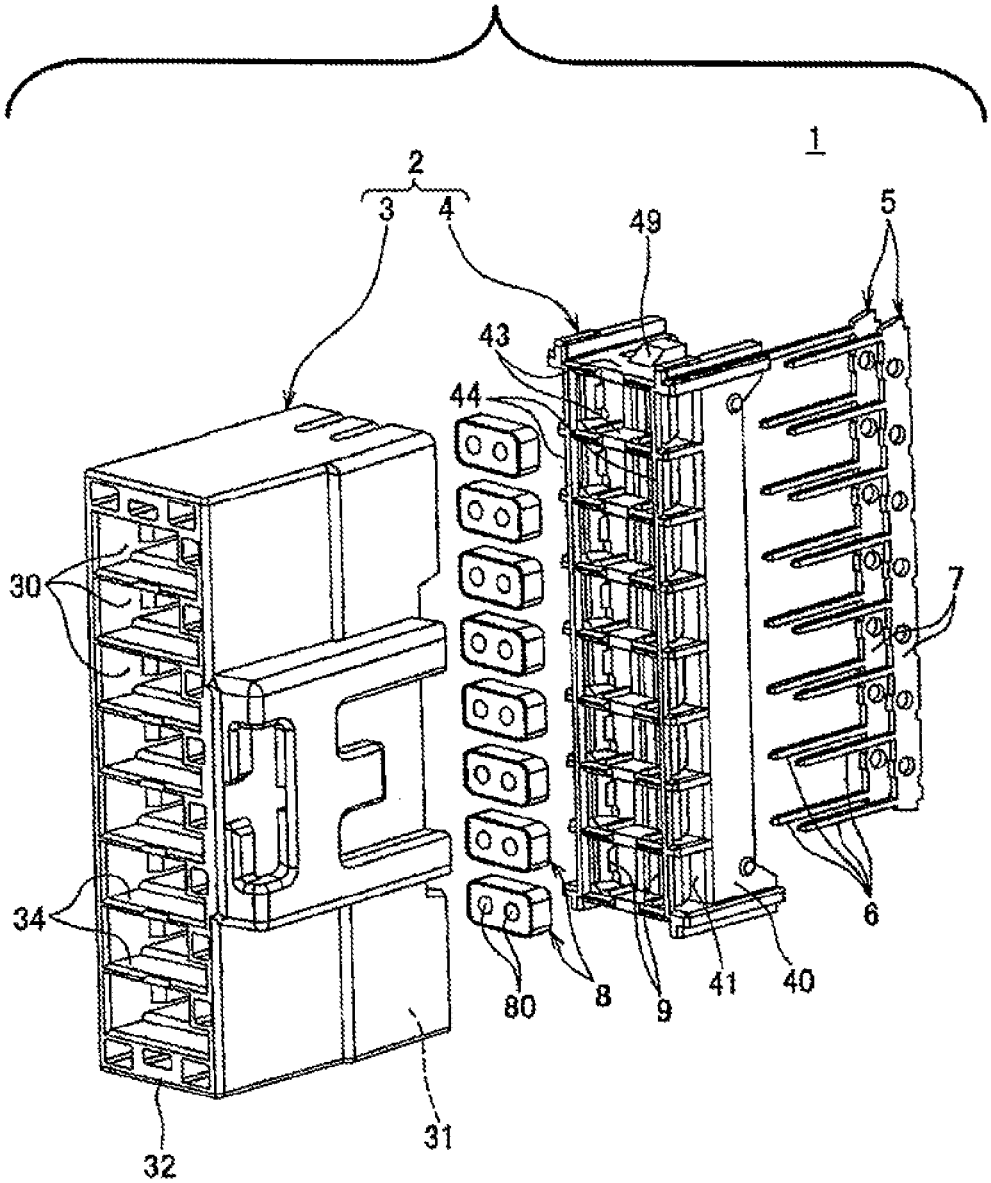
FIG. 2 is an exploded view of the connector shown n FIG. 1.

As shown in FIG. 1 and FIG. 2, the connector I according to the embodiment includes a housing 2, two conductors 5 and a noise removal unit. The housing 2 includes a first housing 3 and a second housing 4, both of which are made of a synthetic resin. The noise removal unit removes noise generated from a plurality of terminals 6 provided in the conductors 5. The noise removal unit includes a plurality of ferrites 8.

Figure 3:
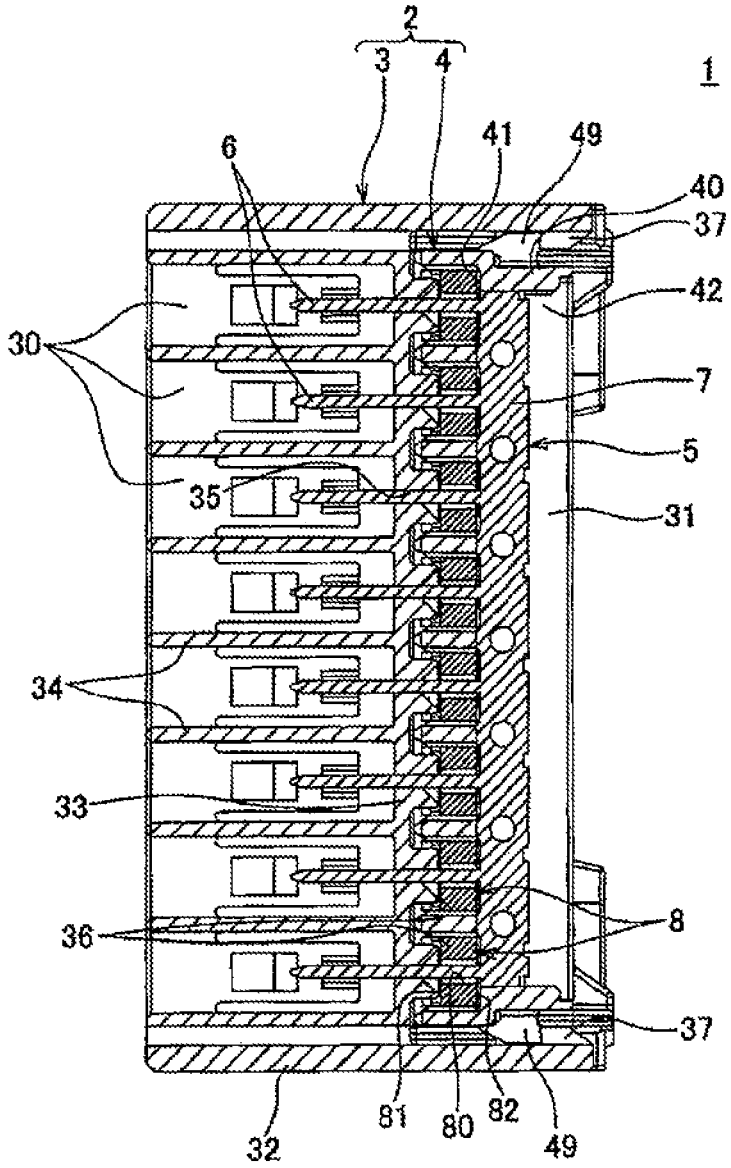
FIG. 3 is a cross-sectional view taken along a line III-III in FIG. 1.

Each of the conductors 5 is obtained by press-working a metallic plate, or the like. As shown in FIG. 2 and FIG. 3, the conductor 5 includes a plurality of terminals 6 which are aligned in parallel to and spaced away from each other, and a belt-shaped linking part 7 which links the plurality of terminals 6 to one another.

Figure 11:
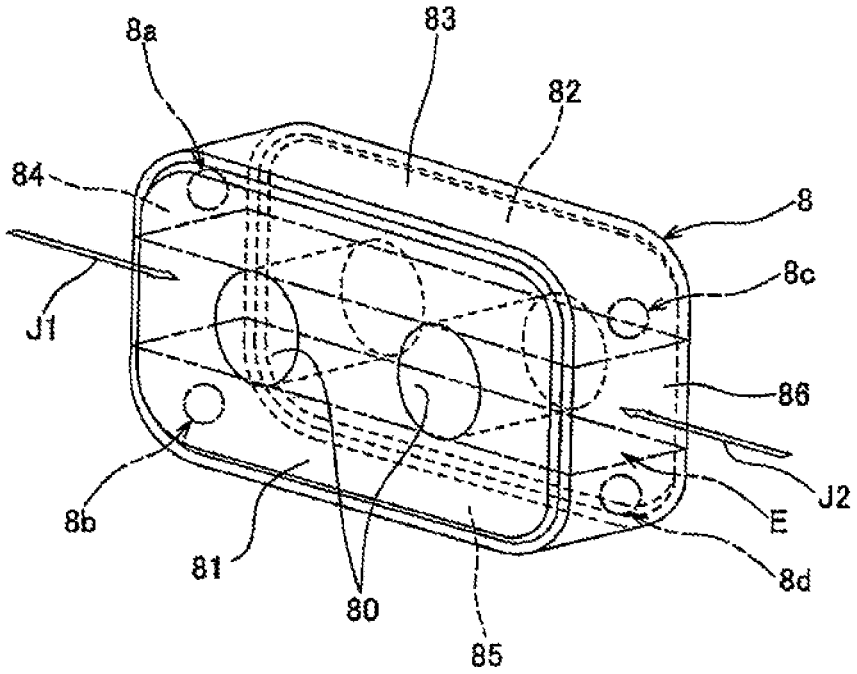
FIG. 11 is an explanatory diagram for explaining an action of the pair of pressing arms shown in FIG. 10.

As shown in FIG. 11, each of the ferrites 8 is formed in a rectangular plate-shape which has an upper surface 81, a lower surface 82 and four side surfaces 83, 84, 85, 86. Two through holes 80 are formed through the center of the ferrite 8 to pass the terminals 6 through them. The two through holes 80 are open on the upper surface 81 and the lower surface 82 of the ferrite 8. The two through holes 80 are arranged to be spaced away from each other along a longitudinal direction of the ferrite 8.

As shown in FIG. 3, the first housing 3 includes a plurality of connector fitting portions 30 which are to be fitted in a plurality of mating connectors, respectively, and a container 31 in which the second housing 4 is contained, the second housing 4 holding the two conductors 5 and the plurality of ferrites 8.

The plurality of connector fitting portions 30 is formed by an outer wall 32 formed in a square tube, a back wall 33 which partitions the inside of the outer wall 32 into two spaces along a center axis of the outer wall 32, and a plurality of partition walls 34 which partition one space of the two spaces located at the left side in FIG. 3 further into a plurality of spaces. The plurality of connector fitting portions 30 are aligned in one line along a direction perpendicular to the center axis of the outer wall 32. The ferrites 8 are provided as many as the connector fitting portions 30. That is, each of the ferrites 8 is provided for each connector fitting portion 30.

As shown in FIG. 3, the container 31 is formed by the outer wall 32, the back wall 33 and a plurality of anti-drop portions 36 which project from a side of the back wall opposite to the connector fitting portions 30. That is, the anti-drop portions 36 are provided as many as the connector fitting portions 30. The plurality of anti-drop portions 36 come close contact to the upper surfaces 81 of the plurality of ferrites 8 held by the second housing 4 to prevent the ferrites 8 from dropping from the second housing 4. A through hole 35 is formed through the back wall 33 and each of the anti-drop portions 36 to pass the terminal 6 through it. In the embodiment of the invention, the anti-drop portion 36 may contact the upper surface 81 of the ferrite 8.

That is, the conductors 5 are attached to the housing 2 so that the plurality of terminals 6 pass through the respective through holes 35 from the container 31 side and project within the respective connector fitting portions 30. One terminal 6 of one conductor 5 and one terminal 6 of the other conductor 5 are arranged within each of the connector fitting portions 30.

As shown in FIG. 3 through FIG. 9, the second housing 4 includes a conductor-attaching portion 40 formed in a rectangular shape, a pair of locking portions 49 provided at opposite sides of the conductor-attaching portion 40, a plurality of upstanding walls 43 which extend from an upper surface 41 of the conductor-attaching portion 40 to be spaced away from each other along a longitudinal direction of the conductor-attaching portion 40, a pair of beams 44, each of which links ends of the plurality of upstanding walls 43 which are separate from the upper surface 41, and a plurality of pressing arms 9 which extend from the pair of beams 44.

Figure 4:
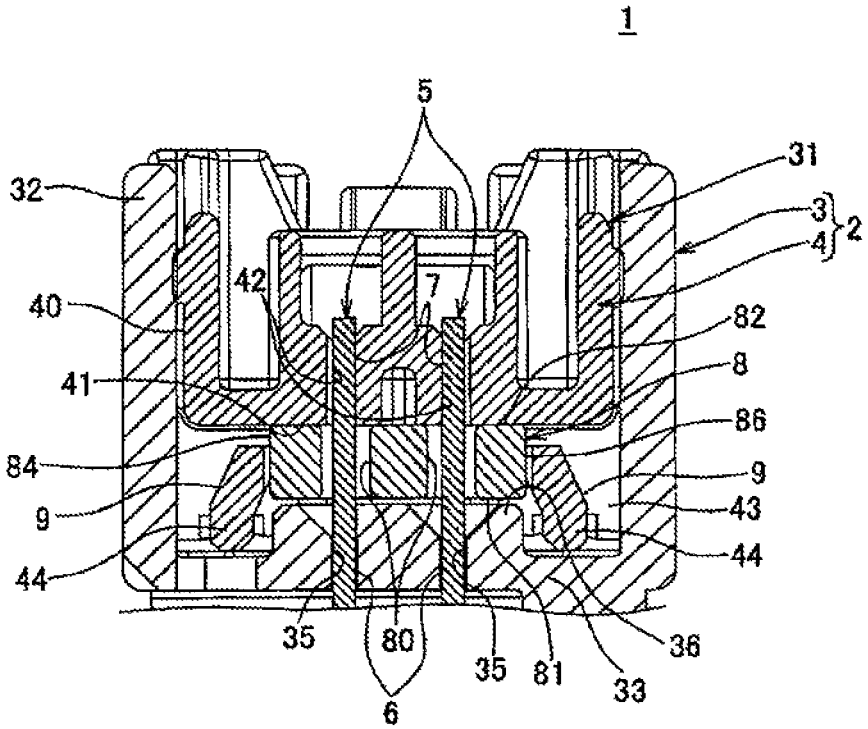
FIG. 4 is a cross-sectional view taken along a line IV-IV in FIG. 1.

Two insertion grooves 42 to which the two conductors 5 are inserted and held are provided in the conductor-attaching portion 40. The two insertion grooves 42 are proved to be spaced away from each other along a width direction of the conductor-attaching portion 40. Further, the two insertion grooves 42 are open on the upper surface 41 and a lower surface of the conductor-attaching portion 40. As shown in FIG. 4, the two conductors 5 are inserted into the respective insertion grooves 42 from a lower side of the conductor-attaching portion 40. Then, the linking parts 7 of the two conductors 5 are received within the insertion grooves 42, and the plurality of terminals 6 project from the upper surface 41 of the conductor-attaching portion 40.

As shown in FIG. 3, the pair of locking portions 49 are locked to a pair of lock-receiving portions 37 provided on the outer wall 32 of the first housing 3, respectively. That is, the second housing 4 is assembled to the first housing 3 by locking the pair of locking portions 49 to the pair of lock-receiving portions 37.

Figure 5:
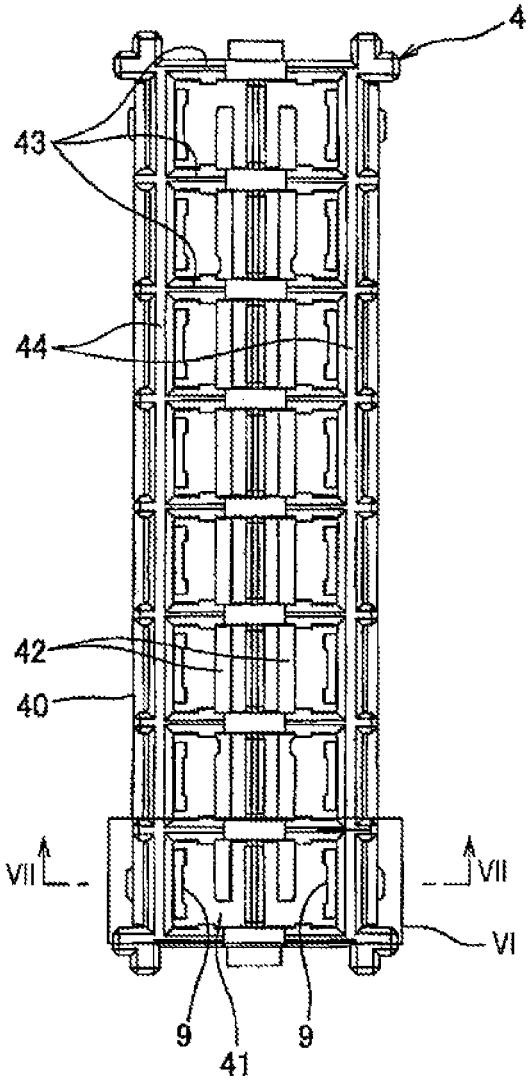
FIG. 5 is a plan view of a second housing shown in FIG. 2.
Figure 6:
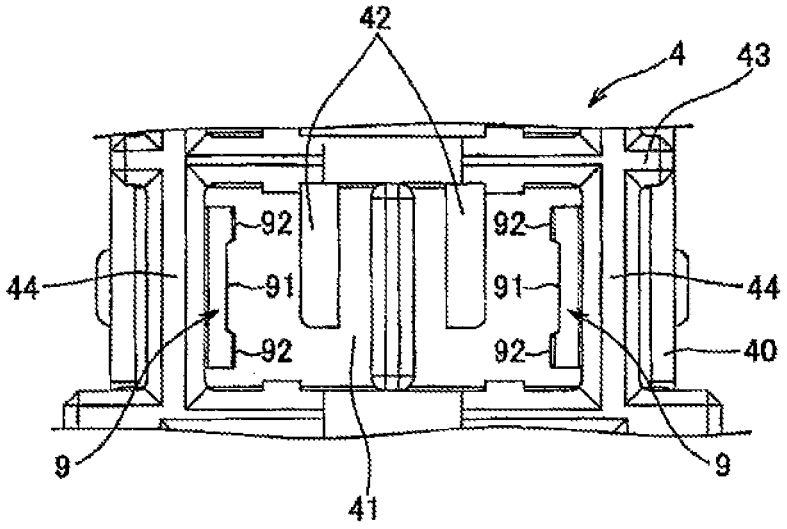
FIG. 6 is an enlarged view of a part VI in FIG. 5.
Figure 8:
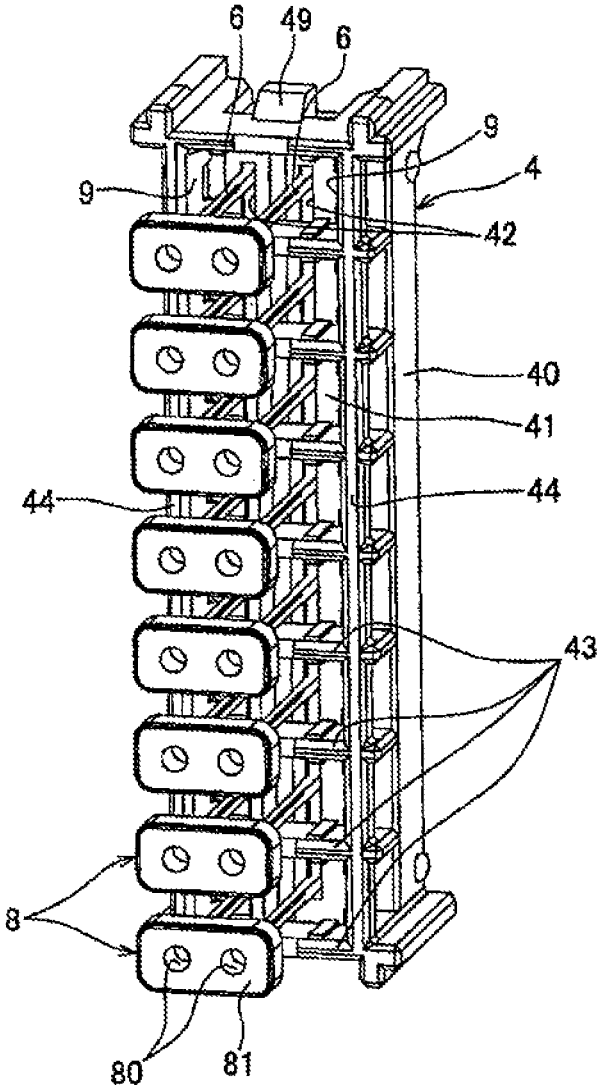
FIG. 8 is a perspective view showing that ferrites are being assembled into the second housing shown in FIG. 2.
Figure 9:
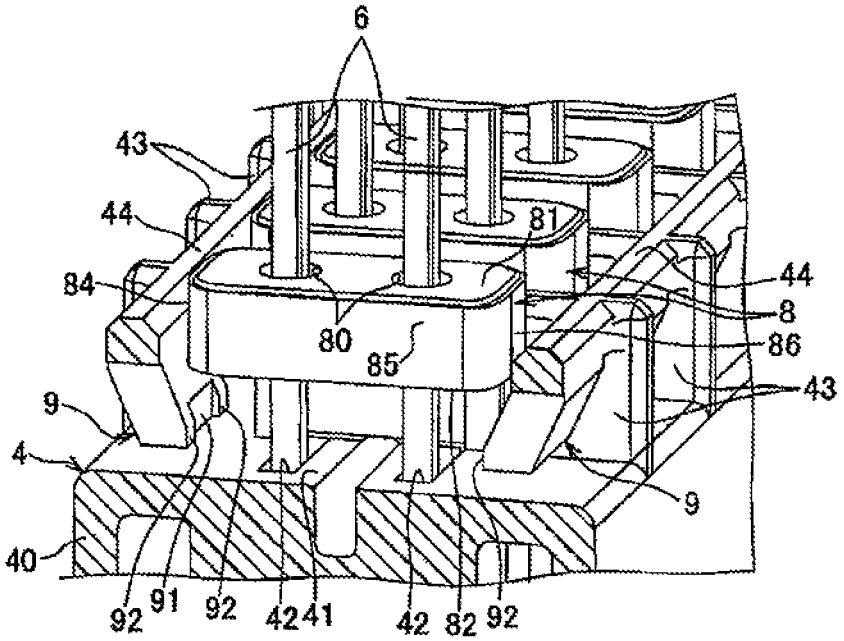
FIG. 9 is a perspective view showing that the ferrites are being fitted between a pair of pressing arms shown in FIG. 8.
Figure 10:
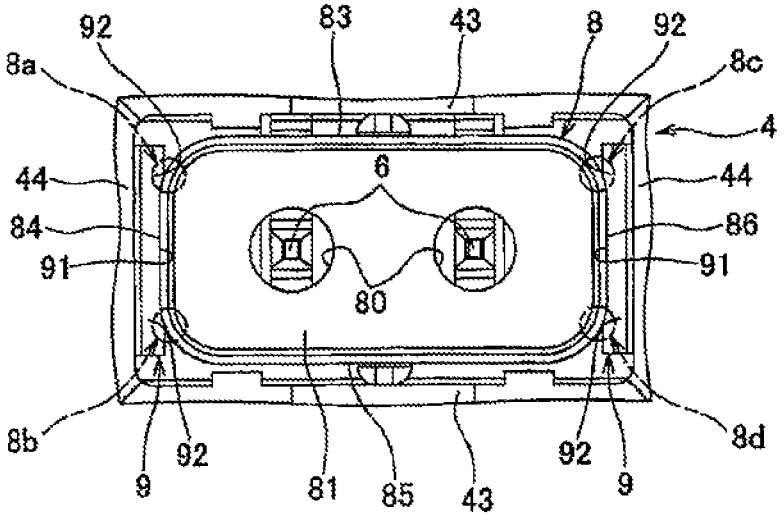
FIG. 10 is a perspective view showing a state where the ferrites have been fitted between the pair of pressing arms shown in FIG. 9.

As shown in FIG. 5, the pair of beams 44 are arranged to be spaced away from each other along the width direction of the conductor-attaching portion 40. The pair of beams 44 and the plurality of upstanding walls 43 constitute a grid in which a plurality of frames are arranged along the longitudinal direction of the conductor-attaching portion 40. As shown in FIG. 8 through FIG. 10, the plurality of ferrites 8 are positioned inside the plurality of frames, respectively, and the lower surface 82 of each ferrite 8 contacts the upper surface 41 of the conductor-attaching portion 40. The upper surface 41 of the conductor-attaching portion 40 may be referred to as a "contact surface".

Figure 7:
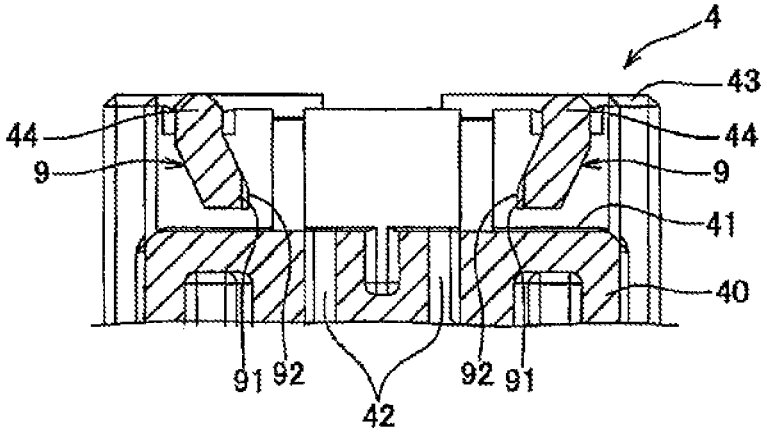
FIG. 7 is a cross-sectional view taken along a line in FIG. 5.

The pressing arm 9 is provided to hold the ferrite 8. One pair of the pressing arms 9 is provided for each of the ferrites 8. As shown in FIG. 9 and the like, the pair of pressing arms 9 are arranged to sandwich each ferrite 8 between them. As shown in FIG. 7, the pair of pressing arms 9 extend from the pair of beams 44 respectively so as to come close to each other, and also extend toward the upper surface 41 of the conductor-attaching portion 40. As shown in FIG. 4, FIG. 10 and the like, each ferrite 8 is fitted between the pair of pressing arms 9 so that the longitudinal direction of the ferrite 8 corresponds to a direction that the pair of pressing arms 9 face each other. That is, the pair of pressing arms 9 face the opposite side surfaces 84, 88 of each ferrite 8 in the longitudinal direction of the ferrite 8.

As shown in FIG. 8 and FIG. 9, an eliminated part 91 is provided on each central portion of the pair of pressing arms 9 (a central portion in a direction perpendicular to the direction that the pair of pressing arms 9 face each other) by eliminating a part of the pressing arm 9. The eliminated parts 91 are provided to prevent the pair of pressing arms 9 from elastically contacting the central portions of the side surfaces 84, 86 of each ferrite 8. That is, the ferrite 8 having a structure in which the two through holes are formed at the central portion is easily deformed when the pressure is applied in an arranged direction of the two through holes 80 (i.e, when the pressure is applied in directions of arrows J1 and J2 shown in FIG. 11) on near the through holes 80 (i.e., on a part E shown by two-dot chain line in FIG. 11). Accordingly, in the embodiment of the invention, the eliminated part 91 is provided so that projections 92 at both sides of the eliminated parts 91 in the pair of pressing arms 9 elastically contact four corners 8*a*, 8*b*, 8*c*, 8*d* of the ferrite 8.

In this way, according to the embodiment of the invention, since the pair of pressing arms which hold the ferrite 8 are provided in plural for each ferrite 8, the pressure to be applied to each ferrite 8 can be lowered in comparison with a case where a ferrite is insert-molded into the housing. Thus, it is possible to suppress the deformation of the ferrite 8. Further, the pressure to be applied to each of the ferrite 8 can be lowered in comparison with a case where a plurality of ferrites are integrally molded. Thus, it is possible to suppress the deformation of the ferrite 8. Moreover, according to the embodiment of the invention, since the projections 92 of the pair of pressing arms 9 press the four corners 8*a*, 8*b*, 8*c*, 8*d* of each of the ferrites 8, the deformation of the ferrite 8 can be minimized. Thus, it is possible to suppress the deterioration of the noise removal capability of each ferrite 8.

According to the embodiment of the invention, when each of the ferrites 8 is being fitted between the pair of pressing arms 9, the pair of beams 44 and the plurality of upstanding walls 43 are interconnected to prevent the deformation of the pair of beams 44.

Next, a procedure of assembling the connector 1 will be explained. First, in a state where the first housing 3 and the second housing 4 are separated from each other, the two conductors 5 are inserted into the insertion grooves 42 of the second housing 4. Next, the terminals 6 which are projected from the upper surface 41 of the conductor-attaching portion 40 are passed through the through holes 80 of the respective ferrites 8, and each of the ferrites is fitted between the respective one pair of pressing arms 9. Then, the second housing 4 which holds the two conductors 5 and the plurality of ferrites 8 is inserted into the container of the first housing 3, and the pair of locking portions 49 are locked to the pair of lock-receiving portions 37. Thus, the second housing 4 is assembled to the first housing 3. In this way, the assembly of the housing 1 is finished.

Next, a connector according to another embodiment of the invention will be explained with reference to FIG. 12 through FIG. 16. In FIG. 12 through FIG. 16, the constituent elements same as those of the connector 1 as described in the embodiment are given same reference numerals, and the detailed description of them is omitted.

The connector according to the other embodiment includes a housing, the two conductors 5 and the plurality of ferrites 8 which remove noise generated from the plurality of terminals 6 provided in the conductors 5. The housing includes the first housing 3 (illustration is omitted, but it has the same structure as the first housing 3 of the connector 1) and a second housing 104 which is made of a synthetic resin.

Figure 12:
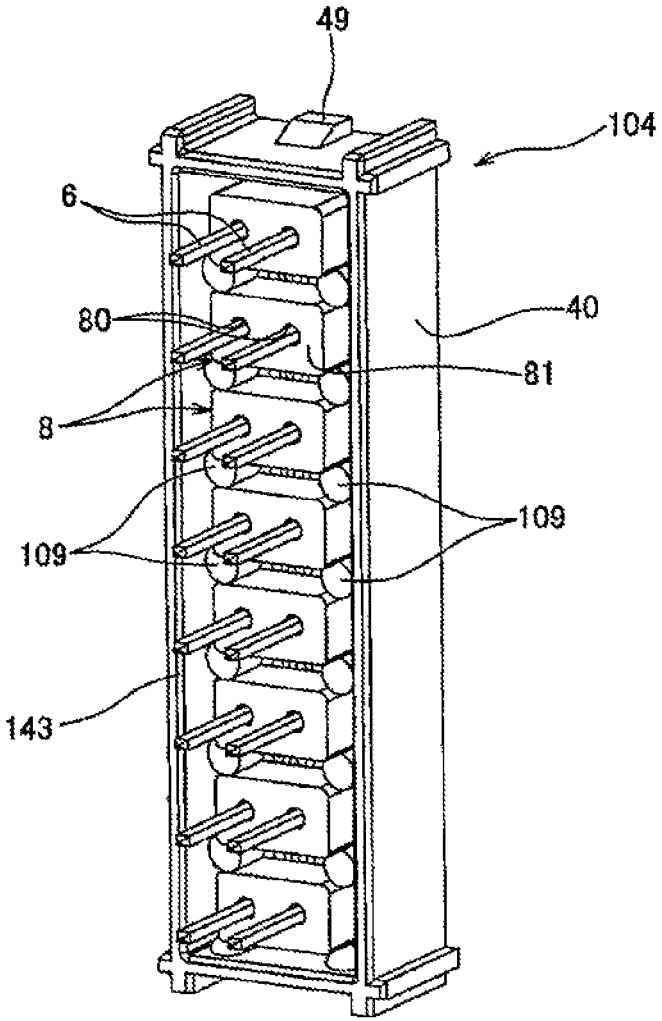
FIG. 12 is a perspective view showing a state where the ferrites are assembled into a second housing which constitutes a part of a connector according to a reference embodiment.
Figure 13:
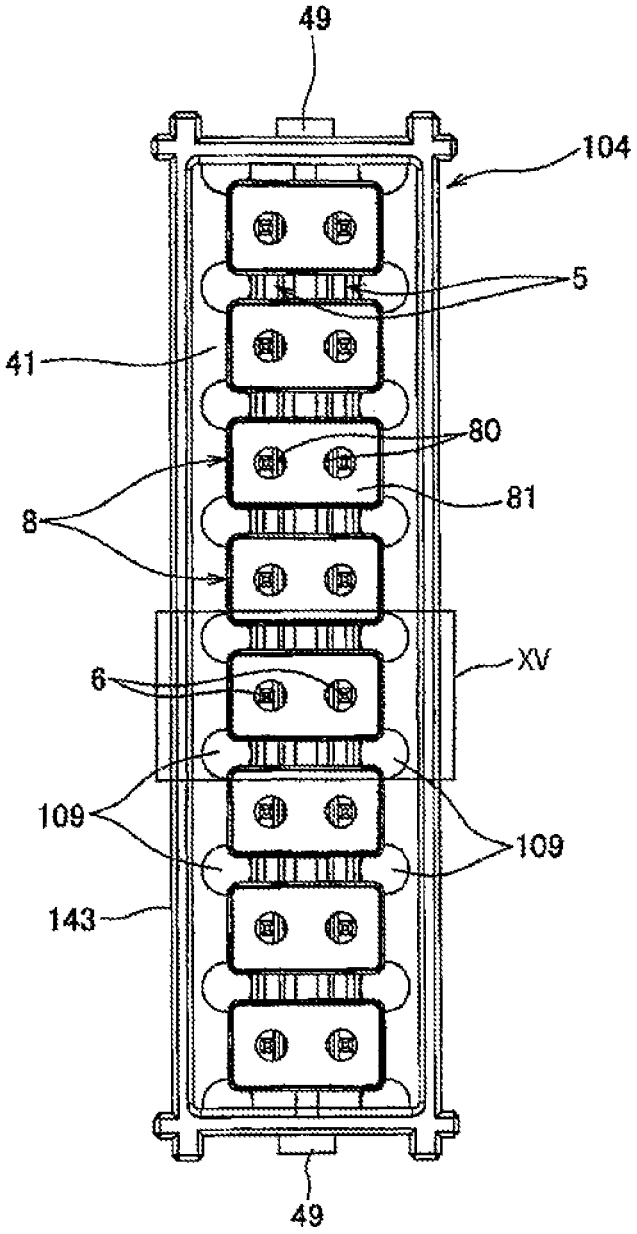
FIG. 13 is a plan view of the second housing and the ferrites shown in FIG. 12.
Figure 14:
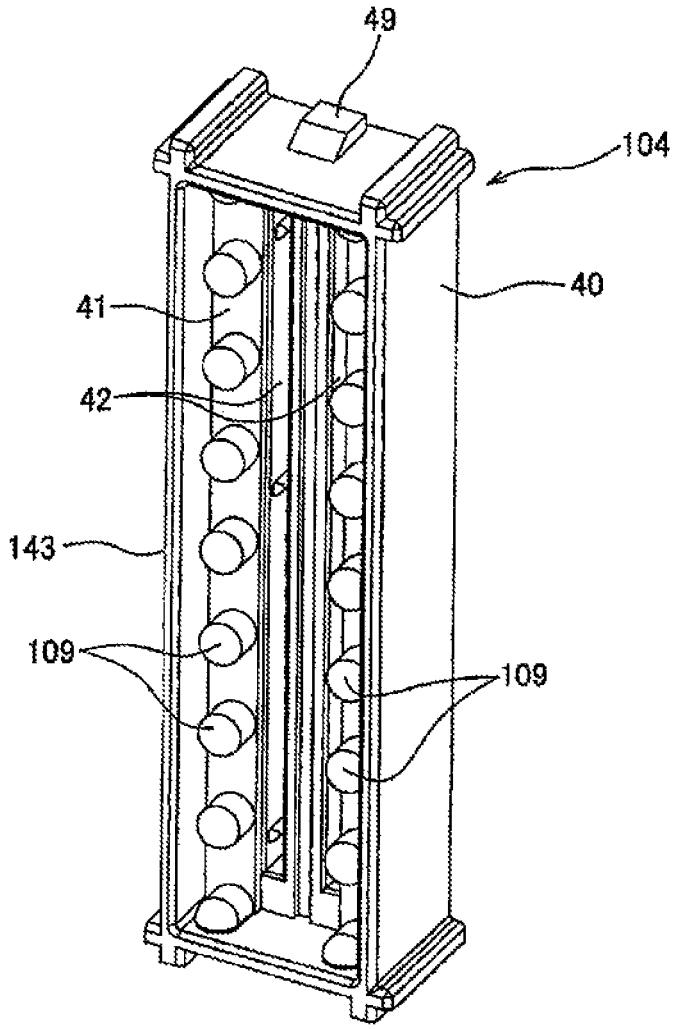
FIG. 14 is a perspective view of the second housing shown in FIG. 12.
Figure 15:
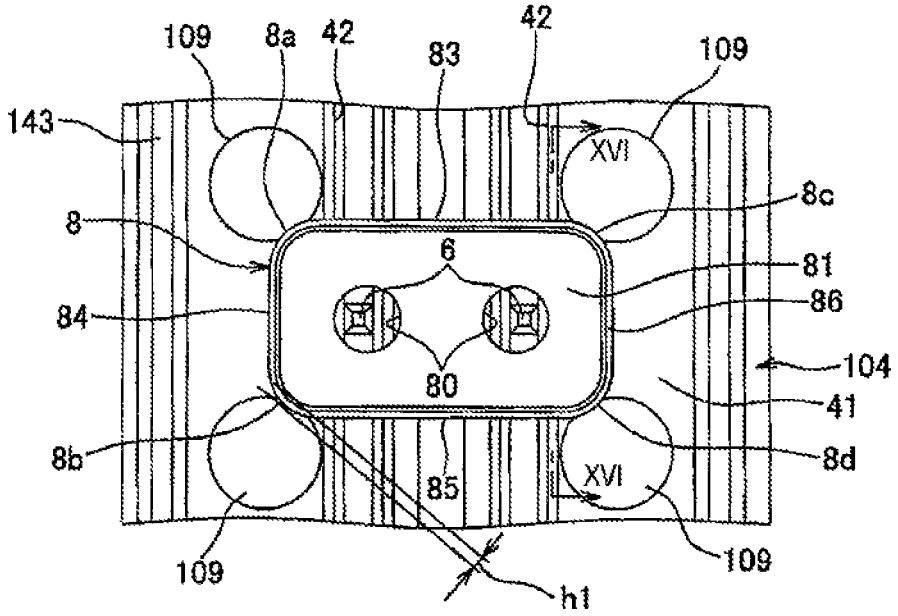
FIG. 15 is an enlarged view of a part XV in FIG. 13.
Figure 16:
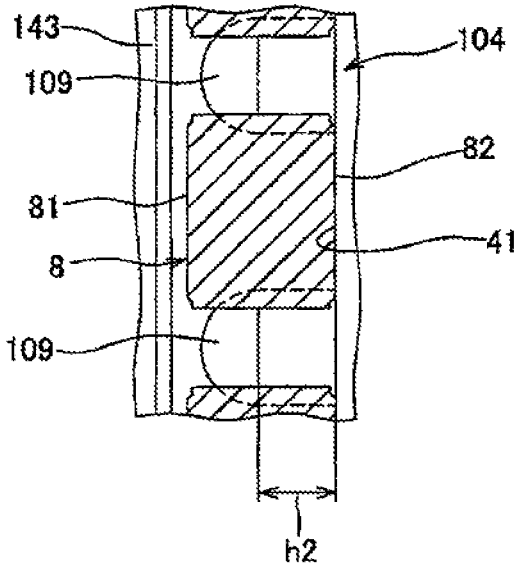
FIG. 16 is a cross-sectional view taken along a line XVI-XVI in FIG. 15.
Figure 17:
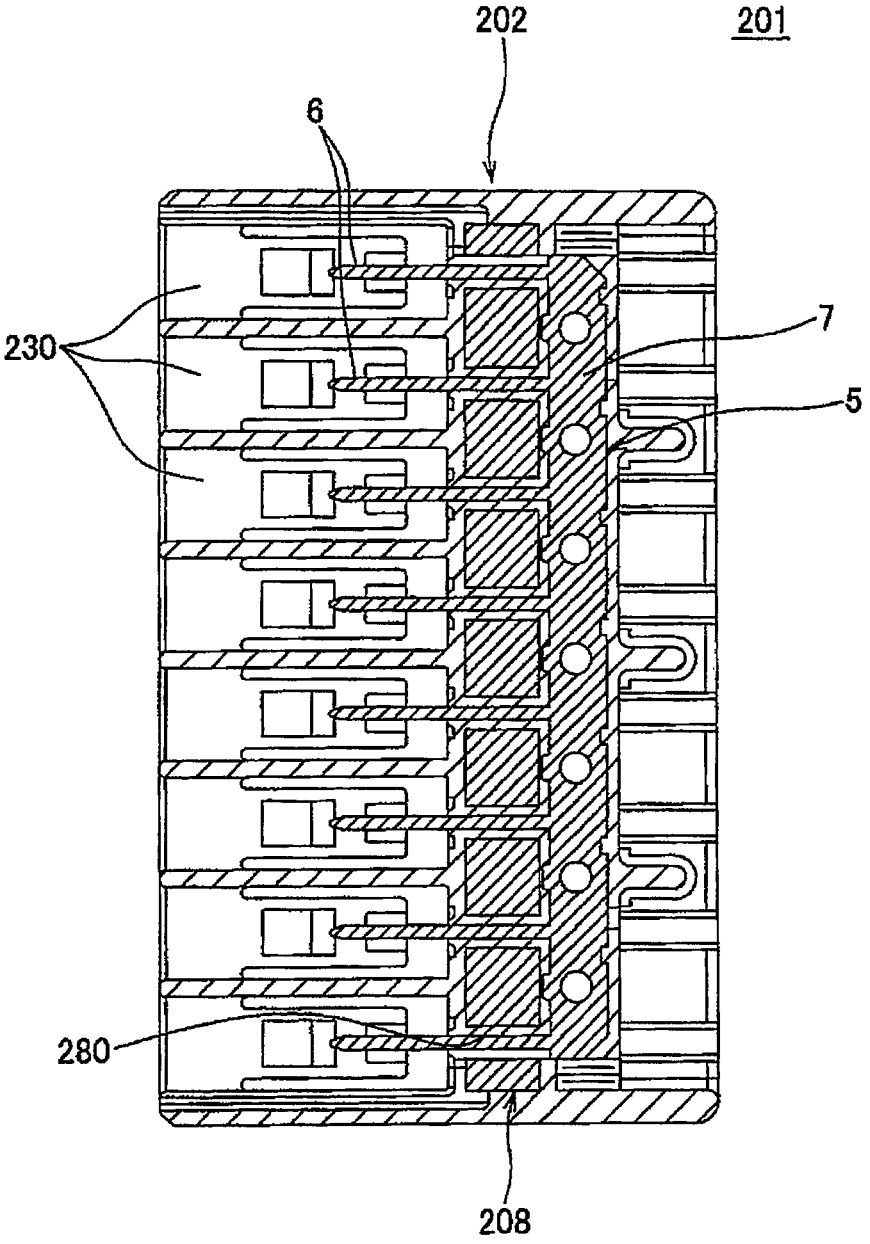
FIG. 17 is a cross-sectional view showing a connector provided with a ferrite plate in a related art.
Figure 18:
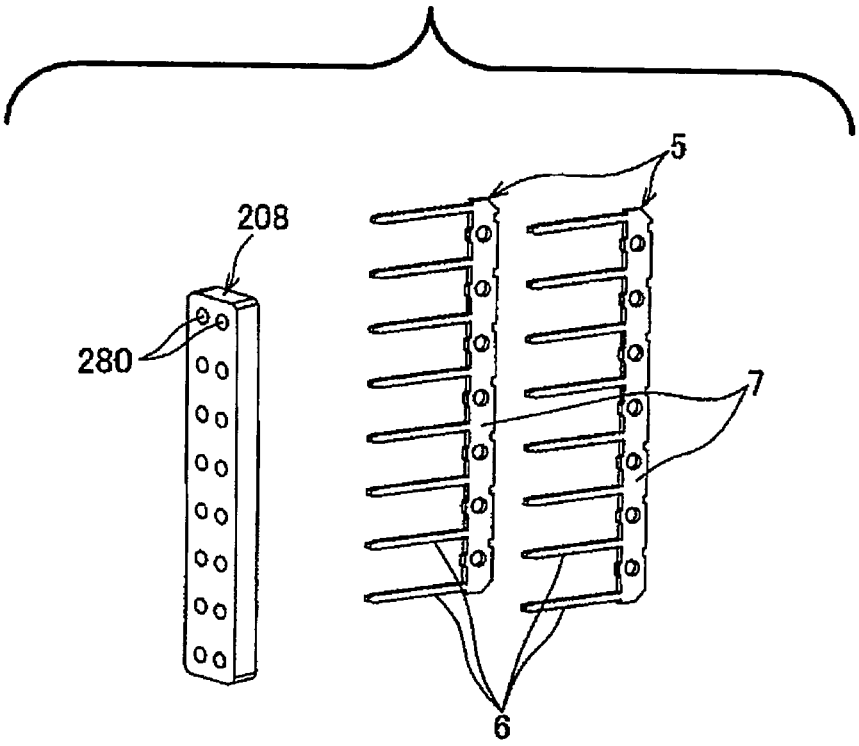
FIG. 18 is a perspective view showing the ferrite plate and a conductor which constitute the connector shown in FIG. 17

As shown in FIG. 12 to FIG. 14, the second housing 104 includes a conductor-attaching portion 40 formed in a rectangular shape, a pair of locking portions 49 provided at opposite sides of the conductor-attaching portion 40, a frame 143 which extends from the upper surface 41 of the conductor-attaching portion 40 in a square tube shape, and a plurality of press-fitting portions 109 which hold the plurality of ferrites 8.

Each of the plurality of press-fitting portions 109 extends from the upper surface 41 of the conductor-attaching portion 40 in a columnar shape. Four of the press-fitting portions 109 are provided for each of the ferrites 8. The four press-fitting portions 109 are arranged so that portions of the press-fitting portions 109 contact the four corners 8*a*, 8*b*, 8*c*, 8*d* of each of the ferrites 8, respectively. That is, each of the ferrites 8 is press-fitted among the four press-fitting portions 109 so as to elastically deform the four press-fitting portions 109 outwardly. The press-fitting width h1 in FIG. 15 and the press-fitting height h2 in FIG. 16 of each of the ferrites 8 are determined to the extent that the functional degradation of the ferrite 8 does not occur.

In this way, according to the connector of the other embodiment, since the four press-fitting portions 109 holds each of the ferrites 8 by elastically contact with the four corners 8*a*, 8*b*, 8*c*, 8*d* of the each of the ferrites 8, the pressure to be applied to each ferrite 8 can be lowered in comparison with a case where a ferrite is insert-molded into the housing. Thus, it is possible to suppress the deformation of the ferrite 8. Further, the pressure to be applied to each of the ferrite 8 can be lowered in comparison with a case where a plurality of ferrites are integrally molded. Thus, it is possible to suppress the deformation of the ferrite 8. Thus, it is possible to suppress the deterioration of the noise removal capability of each ferrite 8.

The above-described embodiments are shown as representative forms of the present invention, and the present invention is not limited to the embodiments. That is, the invention can be implemented by various modifications without departing from the essence of the present invention.

This application is based upon and claims the benefit of priority of Japanese Patent Application No. 2010-210775 filed on Sep. 21, 2010, the contents of which are incorporated herein by reference in its entirety.

Industrial Applicability

The connector according to the aspects of the invention is useful, for example, to be used as a joint connector for multiplex communication in which noise removal capability of the connector is important.

The invention claimed is:

1. A connector, comprising:

a housing which is provided with a plurality of connector fitting portions to be fitted in a plurality of mating connectors, respectively;

a plurality of terminals which are attached to the housing to project within the plurality of connector fitting portions, respectively;

a plurality of ferrites which remove noise generated from the plurality of terminals, each ferrite being provided for the respective one of the connector fitting portions and having through holes through which the plurality of terminals pass, respectively; and a plurality of pressing arms which are provided in the housing, each pressing arm holding the respective one of the plurality of ferrites, wherein the plurality of pressing arms are provided in pairs for each of the plurality of ferrites, each pair of pressing arms are arranged to sandwich the respective one of the ferrites between the pair of pressing arms and press four corners of the respective one of the ferrites, and an eliminated part is formed on a center of each of the pressing arms so that each pair of pressing arms presses the four corners of the respective one of the ferrites and is prevented from contact with centers of side surfaces of the respective one of the ferrites.

2. The connector according to claim 1, wherein each of the ferrites are formed in a rectangular plate shape, and the through holes are formed through a center of the rectangular plate shape.

3. The connector according to claim 1, wherein each of the plurality of pressing arms are provided with two projections, and four projections of the pair of pressing arms press the four corners of the respective one of the ferrites, respectively.

4. The connector according to claim 1, wherein the housing includes a first housing and a second housing, the first housing being provided with the plurality of connector fitting portions, and the second housing being provided with the plurality of pressing arms and assembled to the first housing, each of the ferrites has a first surface on which the through holes are open and a second surface opposite to the first surface on which the through holes are open, the second housing is provided with a contact surface which contacts the first surface of each of the ferrites, and the first housing is provided with a plurality of anti-drop portions which come close to or contact with the second surface of each of the ferrites to prevent each of the ferrites from being dropped from the second housing.

5. The connector according to claim 1, wherein a number of the through holes included in each of the plurality of ferrites is two.

6. The connector according to claim 5, wherein the plurality of ferrites are aligned in a direction orthogonal to an arranged direction of the two through holes of the ferrites.

* * * * *